United States Patent [19]

Asher

[11] 4,266,689

[45] May 12, 1981

[54] CLOSURE FOR TOP INSIDE ROLL CONTAINER

[75] Inventor: Lance A. Asher, Camden Point, Mo.

[73] Assignee: Phillips Petroleum Company, Bartlesville, Okla.

[21] Appl. No.: 80,605

[22] Filed: Oct. 1, 1979

[51] Int. Cl.[3] ..... B65D 39/00

[52] U.S. Cl. ..... 220/307; 220/DIG. 19

[58] Field of Search ..... 220/307, DIG. 19; 229/43; 215/355

[56] References Cited

U.S. PATENT DOCUMENTS

| | | | |
|---|---|---|---|
| 3,206,059 | 9/1965 | Feed et al. . | |
| 3,263,724 | 8/1966 | Mojonnier et al. | 220/307 X |
| 3,358,875 | 12/1967 | Ekstrom | 220/307 X |
| 3,623,628 | 11/1970 | Rericha . | |
| 3,640,418 | 2/1972 | Williams . | |

FOREIGN PATENT DOCUMENTS

| | | | |
|---|---|---|---|
| 1383871 | 11/1964 | France | 220/307 |

*Primary Examiner*—George T. Hall

[57] ABSTRACT

A container and closure combination includes a container with an inside wall roll or bead and a closure adapted for clasping said bead. The closure comprises a central discoidal portion adapted with an outwardly and upwardly flaring first section facilitating insertion of the plug into the container, a bead formed by connecting the first section with an inwardly and upwardly flaring second section, a groove formed by adapting the second section with an outwardly and upwardly flaring third section which is in turn adapted with a closure rim and skirt.

15 Claims, 4 Drawing Figures

CLOSURE FOR TOP INSIDE ROLL CONTAINER

This invention relates to container covers or closures. In another aspect it relates to plug-type closures for containers having a container rim comprising an inside roll or bead. In yet another aspect, it relates to the combination of such closures and such containers.

Containers with a container rim comprising an inside roll, bead, or flange are known in the art. Such containers include paperboard containers with inside rolled rims as well as plastic containers with inside beads or flanges. Such containers when closed with suitable non-bulky closures offer significantly advantageous packing features in comparison to containers having top outside rolled rims or beads. Thus a desirable design feature of closures involves the minimization of the extent to which the closure increases the packing diameter of the container.

Such minimization can be accomplished by plug-type closures. However, such closures which are not provided with a rim and a skirt may permit entry of contaminants into the containers. Accordingly, another design consideration is the provision of means for exclusion of such undesired materials.

Another design consideration is the provision of a closure of a single design which may be used either as an easily removable and resealable closure or which, after appropriate treatment, for example thermal bonding to the container, may serve as a permanent closure.

Accordingly, an object of the present invention is a plug-type closure for a container having a top inside roll or bead. Another object of the invention is a combination of such a closure and such a container which has good bulk packing characteristics. A further object of the present invention is such a closure with means for hindering the introduction of foreign materials into said containers. Another object of the present invention is such a closure which may be used as an easily removable, resealable closure, or after suitable treatment, as a permanent closure. Other objects and advantages of the present invention will appear in the detailed description below and from the accompanying drawings in which:

This invention comprises a container closure for inside roll or bead containers comprised of a central discoidal portion surrounded by and continuous along its extent with a first section flaring outward and upward, attached to a second section flaring inward and upward, attached to a third section flaring outward and upward connected at its upper end to an outwardly extending flat flange-like portion forming a closure rim having an outer portion in the form of a downturned skirt. Relative to the central discoidal portion, the outwardly facing surface of the second and third sections and the downwardly facing surface of the closure rim and the inwardly facing surface of the skirt partially delimit a locking groove adapted to receive the inside roll or bead of an appropriate container. The surfaces can also provide a seal between closure and container.

The invention further comprises the combination of such a closure with a container having a top inside roll or bead.

Figure 1:
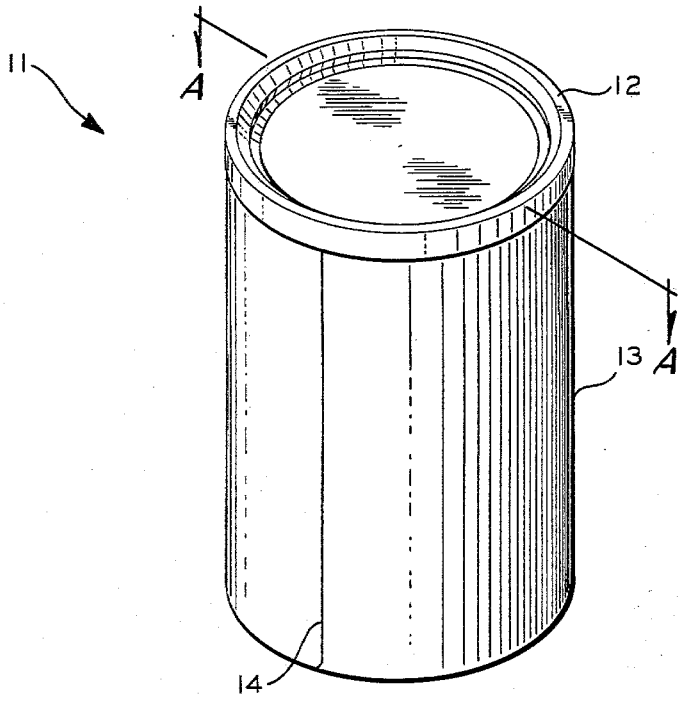
FIG. 1 is an elevational view of a container and closure in accordance with one embodiment of the present invention.
Figure 2:
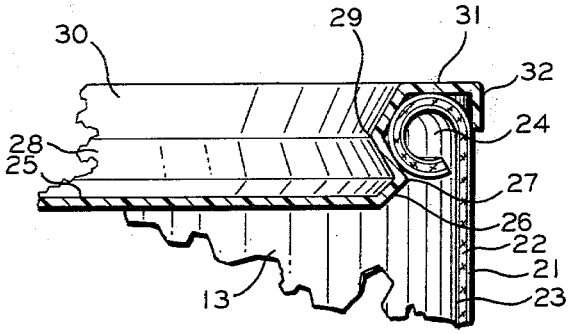
FIG. 2 is a partial enlarged sectional longitudinal view on the line AA of FIG. 1.

A preferred embodiment of the invention is shown in the drawings. Referring now in detail to the drawings, a container 11 with container rim comprising a top inside roll 24, best shown in FIG. 2, is shown in FIG. 1 in the upright position with the closure 12 in place. The illustrated container is a generally cylindrical container 11. The sidewall 13, best shown in FIG. 2, preferably formed of a layer 22 of paperlike fibrous material, such as paperboard, having an outer coating 21 and an inner coating 23 of a suitable thermoplastic material such as polyethylene on the outer and inner surfaces thereof, has been convoluted and the overlapping side margins have been thermally bonded to each other to form a generally cylindrical preform having a side seam 14.

Figure 3:
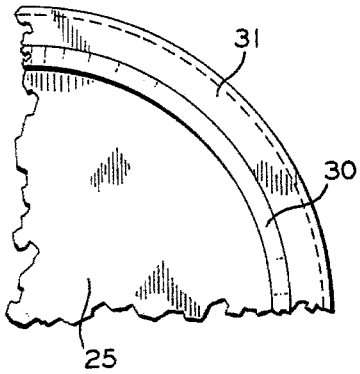
FIG. 3 is a partial top plan view of the closure shown in FIGS. 1 and 2.
Figure 4:
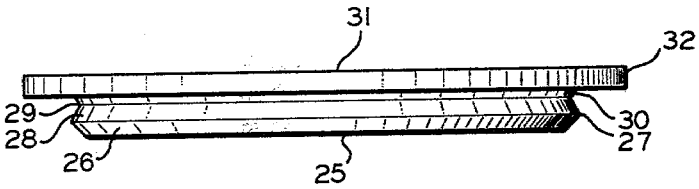
FIG. 4 is an elevational view of the closure shown in FIGS. 1, 2 and 3.

Closure 12, best seen in FIGS. 2, 3, 4, is preferably thermoformed from a thin sheet of a substantially rigid plastic such as polyethylene, polypropylene, polystyrene, and the like, and is generally dish shaped with a central discoidal portion 25 continuous along its extent with a first section 26 flaring upward and outward, a second section 28 continuous with and inverted relative to the first section 26 to flare upward and inward and forming an outside ridge and an inside groove along the line of continuity 27, a third section 30 forming an inside groove and an outside ridge along the line of continuity 29 with section 28, thence flaring outward and upward, and continuous with an outwardly extending flat rim 31 having a downward turned skirt 32. Preferably first section 26, second section 28, and third section 30 are generally frustoconical in shape.

The following characteristics of the closure design will be appreciated. First section 26 facilitates attaching the closure to the container by permitting central discoidal portion 25 to present a relatively smaller diameter surface to the mouth of the closure. During insertion, the ridge 27 pushes past the inside roll 24 of the container due to the elasticity of the plastic and of the container and thereafter expands to return to a conformation similar to its original conformation to retain the closure 12 attached to the container 11. A seal between the closure 12 and the container 11 can be accomplished by means of one or more of the appropriate surfaces corresponding to the outward facing surfaces, relative to the central discoidal disk, of sections 28 and 30, the downward facing surface of closure rim 31 and the inward facing surface of the skirt 32. In addition, the elasticity of the plastic may be further utilized so that the skirt 32 and sections 28 and 30 compress top inside roll 24 of the container between them thereby releasably retaining the top inside roll. In addition, the closure rim 31 and skirt 32 combination prevents contamination of the rim and interior of the container from outside sources. It will further be appreciated that the thickness of the skirt 32 may be reduced to improve packing density of the container-closure combination to provide a container closure combination of substantially uniform diameter, or may be angled inward and/or increased in length to improve the seal between the container and the closure. Furthermore, the length of the skirt may be increased in length as desired to provide a contaminant-free outside container surface or dispensing lip below the rim after removal of the closure. During removal, the ridge 27 pushes past the top inside roll or container rim 24 of the container 11 due to the elasticity of the container and closure, and thereafter resumes a conformation similar to its original conformation. Due to the elasticity of the plastic from which the closure is made, the closure may be used repeatedly if it is not thermally bonded to the container. Alternatively, the closure 12 may be made permanent by hot-melting or thermally bonding the closure 12 to the container 11 as is known in the art.

In a preferred embodiment the skirt 32, closure rim 31 and sections 26, 28, 30 join the central discoidal portion 25 to form a dish-like depression.

In containers used in the present invention, the sidewall can be formed of a single thickness of sidewall material or of multiple plies of sidewall material. The sidewall can be formed using any technique known in the art as being suitable for producing tubes. One technique involves folding a sidewall blank around a mandrel so that one side of one margin of said blank is overlapped and secured to the opposite side of the opposite edge margin of said blank. Such a technique is discussed in both U.S. Pat. Nos. 3,944,126 and 3,369,726.

Preferably, the rim on the top end of the container comprises an upper end portion of the sidewall extending inwardly, downwardly, and outwardly in a generally continuously curved fashion so that the surface of the inwardly disposed rim is generally curved. Such a container is said to have a top inside roll or bead. The upper end portion of the sidewall may be rolled upon itself to whatever extent is desired.

The material used for the sidewalls is not considered to be critical. For example, paperboard or plastics such as polyethylene, polypropylene and the like can be employed. Similarly, the type of bottom closure employed in this invention is not considered critical. Any type of bottom closure known in the art as suitable for sealing the bottom of conical or cylindrical containers can be employed. In a preferred embodiment, as shown in FIG. 1, where the sidewall and the bottom closure (not shown) are both formed of paperboard, the bottom closure can be a generally cylindrical disk having a depending skirt which is bonded to the lower portion of the sidewall and rolled and crimped inwardly with the bottom edge of the sidewall to form a crimped seal. An example of such a bottom closure is disclosed in U.S. Pat. No. 3,944,126.

Alternatively, the bottom rim may have a bottom inside roll or bead as described above for the top container rim and may be adapted with a closure according to the instant invention as claimed which may be bonded to said container. The bottom closure may then be bonded to the lower edge of the inwardly rolled rim in any suitable manner known in the art. For example, adhesives of various types can be used, including thermoplastic and thermosetting materials.

To further illustrate my invention, the following example is provided. Reference numerals therein refer to the drawings.

EXAMPLE

A container made in accordance with the present invention can have a top inside roll 24 having an overall width of 0.250 inches (0.635 cm), an outside diameter of 2.875 inches (7.30 cm), and an inside diameter at the roll 24 of 2.375 inches (6.03 cm). A closure suitable for such a container can be made from a 0.018 inch (0.045 cm) thick polystyrene sheet and thermoformed to the configuration shown in the drawings. Such a closure can have an outside diameter along line 27 of 2.60 inches (6.60 cm), an outside diameter along line 29 of 2.30 inches (5.84 cm), and a width along the lower surface of rim 31 adjacent top inside roll 24 of 0.175 inches (0.444 cm) in order to slightly compress the top inside roll 24 to form a seal.

It is to be understood that while there has been illustrated a preferred embodiment of certain aspects of the invention, the invention is not limited to the specific form or arrangement herein described and shown except to the extent that such limitations are found in the claims.

That which is claimed and sought to be secured by letters patent is:

1. A closure comprising:
a central discoidal portion;
a first section flaring upward and outward relative to and continuous along the extent of said central discoidal portion;
a second section flaring upward and inward continuous with said first section and forming an outside ridge and an inside groove along the line of continuity with said first section;
a third section flaring upward and outward continuous with said second section and forming an inside ridge and an outside groove along the line of continuity with said second section;
a closure rim having a downward turned skirt directed outward relative to said central discoidal portion and continuous with said third section; and
a skirt directed downward continuous with said rim.

2. A closure as in claim 1 wherein:
the first, second, and third sections are generally frustoconical.

3. A closure as in claim 1 wherein:
said first section, said second section, said closure rim, and said skirt form a locking groove to releasably retain an inside roll or bead of a container rim.

4. A closure as in claim 3 wherein:
at least one surface of said locking groove contacts said inside roll or bead to form a seal therebetween.

5. A closure as in claims 1, 2, 3, or 4 wherein:
said closure is formed from a thermoformable plastic.

6. A closure as in claim 5 wherein:
said closure is formed of a material selected from the group consisting of polyethylene, polypropylene, and polystyrene.

7. In combination with a cylindrical container having at least one container rim extending inwardly, downwardly, and outwardly in a generally continuously curved fashion comprising an inside roll or bead, a molded plastic closure for said container, said closure comprising:
a central discoidal portion;
a first section flaring upward and outward relative to and continuous with the extent of said central discoidal portion;
a second section flaring upward and inward continuous with said first section and forming an outside ridge and an inside groove along the line of continuity with said first section;
a third section flaring upward and outward continuous with said second section and forming an inside ridge and an outside groove along the line of continuity with said second section;
a closure rim directed outward relative to said central discoidal portion and continuous with said third section;
a skirt directed downward continuous with said rim; and wherein said second section, said third section, said closure rim, and said skirt of said closure form a locking groove to releasably retain said inside roll or bead.

8. The combination as in claim 7 wherein:

said first, second, and third sections are generally frustoconical.

9. The combination as in claim 7 wherein:

said container is formed from paperboard; and said closure is formed of a material selected from the group consisting of polyethylene, polypropylene, and polystyrene.

10. The combination as in claim 7 wherein:

said combination provides a package of at least substantially uniform diameter.

11. The combination as in claim 10 wherein:

said skirt is adapted to said container to provide an uncontaminated dispensing lip on said container upon removal of said closure.

12. The combination as in claim 10 wherein:

at least one surface of said locking groove contacts said inside roll or bead to form a seal therebetween.

13. The combination as in claim 12 wherein the cylindrical container has two container rims having inside rolls or beads.

14. The combination as in claim 13 wherein:

both rims are adapted with said molded plastic closure.

15. The combination as in claim 10 wherein:

at least one of said closures is permanently bonded to said container.

* * * * *